US009891564B2

(12) United States Patent
Eguchi

(10) Patent No.: US 9,891,564 B2
(45) Date of Patent: Feb. 13, 2018

(54) FIXING DEVICE AND IMAGE FORMING APPARATUS

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventor: Atsuhiko Eguchi, Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/299,496

(22) Filed: Oct. 21, 2016

(65) Prior Publication Data

US 2017/0082956 A1 Mar. 23, 2017

Related U.S. Application Data

(63) Continuation of application No. 14/856,644, filed on Sep. 17, 2015, now Pat. No. 9,507,299.

(51) Int. Cl.
*G03G 15/20* (2006.01)

(52) U.S. Cl.
CPC ..... *G03G 15/205* (2013.01); *G03G 15/2039* (2013.01); *G03G 15/2003* (2013.01); *G03G 15/2078* (2013.01); *G03G 15/2082* (2013.01); *G03G 2215/2009* (2013.01); *G03G 2215/2016* (2013.01); *G03G 2215/2032* (2013.01)

(58) Field of Classification Search
CPC ..... G03G 15/2078
USPC ..... 399/69
See application file for complete search history.

(56) References Cited

U.S. PATENT DOCUMENTS 4,922,293 A * 5/1990 Bando ..... G03G 21/14 399/38
5,600,406 A * 2/1997 Aikawa ..... G03G 15/205 399/328
5,682,577 A * 10/1997 Kiyoi ..... G03G 15/2039 219/494
5,789,723 A * 8/1998 Hirst ..... G03G 15/80 219/216
5,987,275 A * 11/1999 Toyohara ..... G03G 15/2003 219/216
7,046,949 B2 * 5/2006 Tomita ..... G03G 15/2053 219/216

(Continued)

FOREIGN PATENT DOCUMENTS

JP 2011221106 * 4/2011 ..... G03G 15/20
JP 2011-221106 11/2011

OTHER PUBLICATIONS

Non-Final Office Action for U.S. Appl. No. 14/856,644 dated Jan. 29, 2016.

*Primary Examiner* — Clayton E LaBalle
*Assistant Examiner* — Kevin Butler
(74) *Attorney, Agent, or Firm* — Amin, Turocy & Watson LLP

(57) ABSTRACT

According to one embodiment, a fixing device includes a heat roller, a heat generating body, and a controller. The heat roller heats a conveyed sheet. The heat generating body generates heat with electric power in the heat roller. The controller applies thinning control to electric energy supplied to the heat generating body in processing for heating the heat roller.

9 Claims, 8 Drawing Sheets

(56) References Cited

U.S. PATENT DOCUMENTS

| | | | | |
|---|---|---|---|---|
| 7,109,440 | B2 * | 9/2006 | Lee | G03G 15/2039 219/216 |
| 7,783,217 | B2 * | 8/2010 | Maeda | G03G 15/2039 399/328 |
| 8,942,589 | B2 * | 1/2015 | Asami | G03G 15/2042 219/216 |
| 2002/0031362 | A1 * | 3/2002 | Baba | G03G 15/205 399/69 |
| 2002/0041772 | A1 * | 4/2002 | Makihira | G03G 15/2039 399/69 |
| 2003/0147663 | A1 * | 8/2003 | Fukutome | G03G 15/2039 399/69 |
| 2003/0190170 | A1 * | 10/2003 | Hamada | G03G 15/205 399/69 |
| 2007/0036571 | A1 * | 2/2007 | Kagawa | G03G 15/2039 399/69 |
| 2007/0217808 | A1 * | 9/2007 | Maeda | G03G 15/2053 399/69 |
| 2011/0305474 | A1 * | 12/2011 | Tanaka | G03G 15/2053 399/69 |
| 2012/0014732 | A1 * | 1/2012 | Eguchi | G03G 15/6552 399/397 |
| 2012/0321335 | A1 * | 12/2012 | Fujiwara | G03G 15/2078 399/69 |
| 2014/0064754 | A1 * | 3/2014 | Hara | G03G 15/2039 399/43 |
| 2015/0355584 | A1 * | 12/2015 | Ishikawa | G03G 15/6517 399/69 |

* cited by examiner

FIXING DEVICE AND IMAGE FORMING APPARATUS

CROSS-REFERENCE TO RELATED APPLICATIONS

This application is a Continuation of application Ser. No. 14/856,644 filed on Sep. 17, 2015, the entire contents of which are incorporated herein by reference.

FIELD

Embodiments described herein relate generally to a fixing device and an image forming apparatus.

BACKGROUND

In an image forming apparatus such as a multifunction peripheral, warming-up processing for raising the temperature of a heat roller of a fixing device has been performed. In the warming-up processing, heat generation of a heating device (e.g., a fixing lamp) is maintained until the temperature of the heat roller reaches a target temperature. In recent years, in order to adapt the image forming apparatus to a stricter energy saving standard, there is a demand for a reduction in time until the temperature of the heat roller reaches the target temperature (hereinafter referred to as "reaching time"). Therefore, a configuration for increasing temperature rising speed is adopted.

However, if the temperature rising speed is increased, overshoot (over temperature) after the temperature reaching the target temperature is likely to increase.

DETAILED DESCRIPTION

Figure 1:
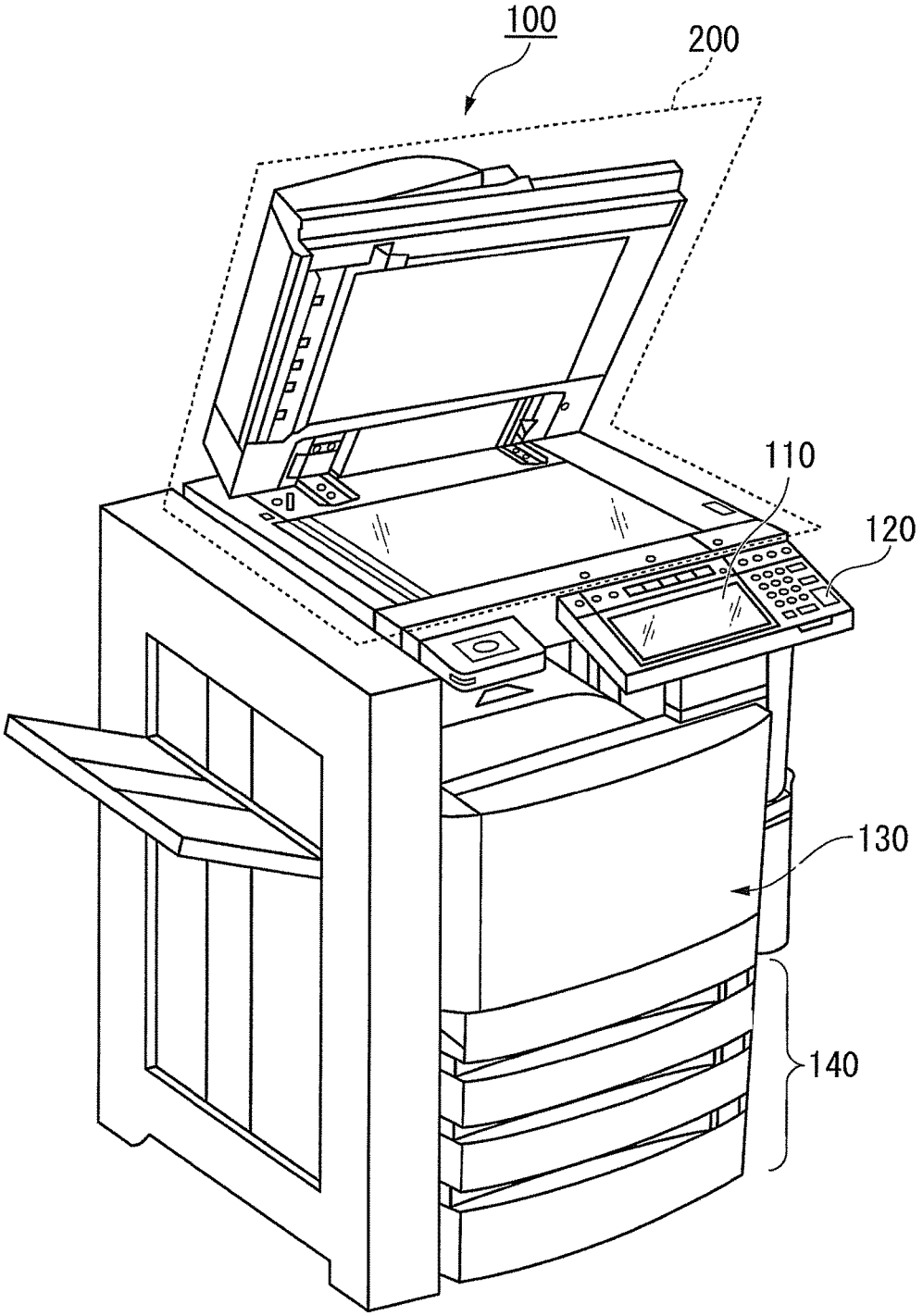
FIG. 1 is an external view showing an overall configuration example of an image forming apparatus in an embodiment.

In general, according to one embodiment, a fixing device includes a heat roller, a heat generating body, and a controller. The heat roller heats a conveyed sheet. The heat generating body generates heat with electric power in the heat roller. The controller applies thinning control to electric energy supplied to the heat generating body in processing for heating the heat roller.

An image forming apparatus 100 in an embodiment is explained with reference to the drawings. In the drawings, the same components are denoted by the same reference numerals and signs.

FIG. 1 is an external view showing an overall configuration example of the image forming apparatus 100 in the embodiment. The image forming apparatus 100 is, for example, a multifunction peripheral. The image forming apparatus 100 includes a display 110, a control panel 120, a printer section 130, a sheet storing section 140, and an image reading section 200. Note that the printer section 130 of the image forming apparatus 100 may be a device that fixes a toner image or a device of an inkjet type.

The image forming apparatus 100 forms an image on a sheet using a developer such as toner. The sheet is, for example, paper or a label sheet. The sheet may be anything as long as the image forming apparatus 100 can form an image thereon.

The display 110 is an image display device such as a liquid crystal display or an organic EL (Electro Luminescence) display. The display 110 displays various kinds of information concerning the image forming apparatus 100.

The control panel 120 includes a plurality of buttons. The control panel 120 receives operation of a user. The control panel 120 outputs a signal corresponding to the operation performed by the user to a controller of the image forming apparatus 100. Note that the display 110 and the control panel 120 may be configured as an integral touch panel.

The printer section 130 forms an image on the sheet on the basis of image information generated by the image reading section 200 or image information received via a communication path. The printer 130 forms an image by performing, for example, processing explained below. An image forming device of the printer section 130 forms an electrostatic latent image on a photoconductive drum on the basis of the image information. The image forming device of the printer section 130 forms a visible image by depositing a developer on the electrostatic latent image. One of specific examples of the developer is toner. A transfer device of the printer section 130 transfers the visible image onto the sheet. A fixing device of the printer section 130 heats and pressurizes the sheet to thereby fix the visible image on the sheet. Note that the sheet on which the image is formed may be a sheet stored in the sheet storing section 140 or may be a manually fed sheet.

The sheet storing section 140 stores sheets used for the image formation in the printer section 130.

The image reading section 200 reads reading target image information as contrast of light. The image reading section 200 records the read image information. The recorded image information may be transmitted to another information processing apparatus via a network. The recorded image information may be formed as an image on the sheet by the printer section 130.

Figure 2:
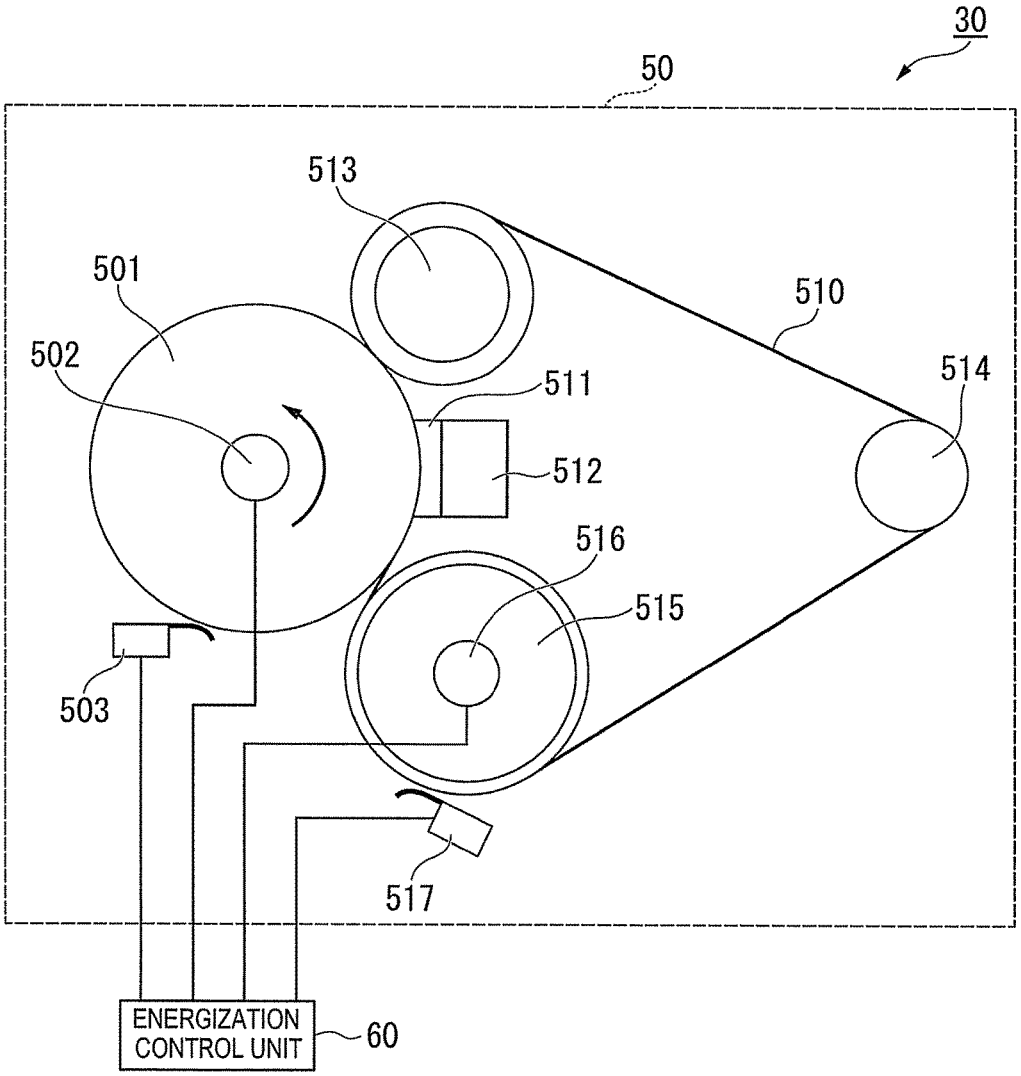
FIG. 2 is a schematic diagram showing a configuration example of a fixing device.

FIG. 2 is a schematic diagram showing a configuration example of a fixing device 30. The fixing device 30 includes a fixing unit 50 and an energization controller 60. The fixing unit 50 fixes a visible image on a conveyed sheet. The energization controller 60 controls electric power supplied to a lamp of the fixing unit 50.

Details of the fixing unit 50 are explained below. The fixing unit 50 is a part of the fixing device 30 included in the printer section 130. The fixing unit 50 includes a heat roller 501, an HR lamp 502, an HR thermistor 503, a pressurizing belt 510, a pressurizing pad 511, a pad holder 512, a pressurizing roller 513, a tension roller 514, a belt heat roller 515, a pressurizing belt lamp 516, and a pressurizing thermistor 517.

The heat roller 501 is a fixing member formed in a cylindrical shape. The HR lamp 502 is provided on the inside of the heat roller 501. The HR lamp 502 generates heat to thereby heat the heat roller 501. The HR lamp 502 is configured using, for example, a halogen lamp. The HR thermistor 503 measures the surface temperature of the heat roller 501.

The pressurizing belt 510 is held by the pressurizing roller 513, the tension roller 514, and the belt heat roller 515. The pressurizing belt 510 is brought into pressurized contact with the heat roller 501 by the pressurizing pad 511 and the pressurizing roller 513. A fixing nip portion is formed between the pressurizing belt 510 and the heat roller 501 by this pressurized contact.

The pressurizing pad 511 is held in a state in which the pressurizing pad 511 is in pressurized contact with the heat roller 510 via the pressurizing belt 510. The pad holder 512 holds the pressurizing pad 511 in a state in which the pressurizing pad 511 is in pressurized contact with the heat roller 501.

The pressurizing roller 513 is disposed downstream in a conveying direction of the sheet. The pressurizing roller 513 brings the pressurizing belt 510 into pressurized contact with the heat roller 501. An exit of the fixing nip portion is formed by the pressurizing roller 513. The tension roller 514 is disposed in a position away from the pressurizing roller 513 and the belt heat roller 515 to thereby apply tension to the pressurizing belt 510. The belt heat roller 515 is disposed upstream in the conveying direction of the sheet. The belt heat roller 515 is formed in a hollow cylindrical shape. The pressurizing belt lamp 516 is provided on the inside of the belt heat roller 515. The pressurizing belt lamp 516 generates heat to heat the belt heat roller 515. The pressurizing belt lamp 516 is configured using, for example, a halogen lamp. The pressurizing thermistor 517 measures the surface temperature of the pressurizing belt 510 near the belt heat roller 515.

Figure 3:
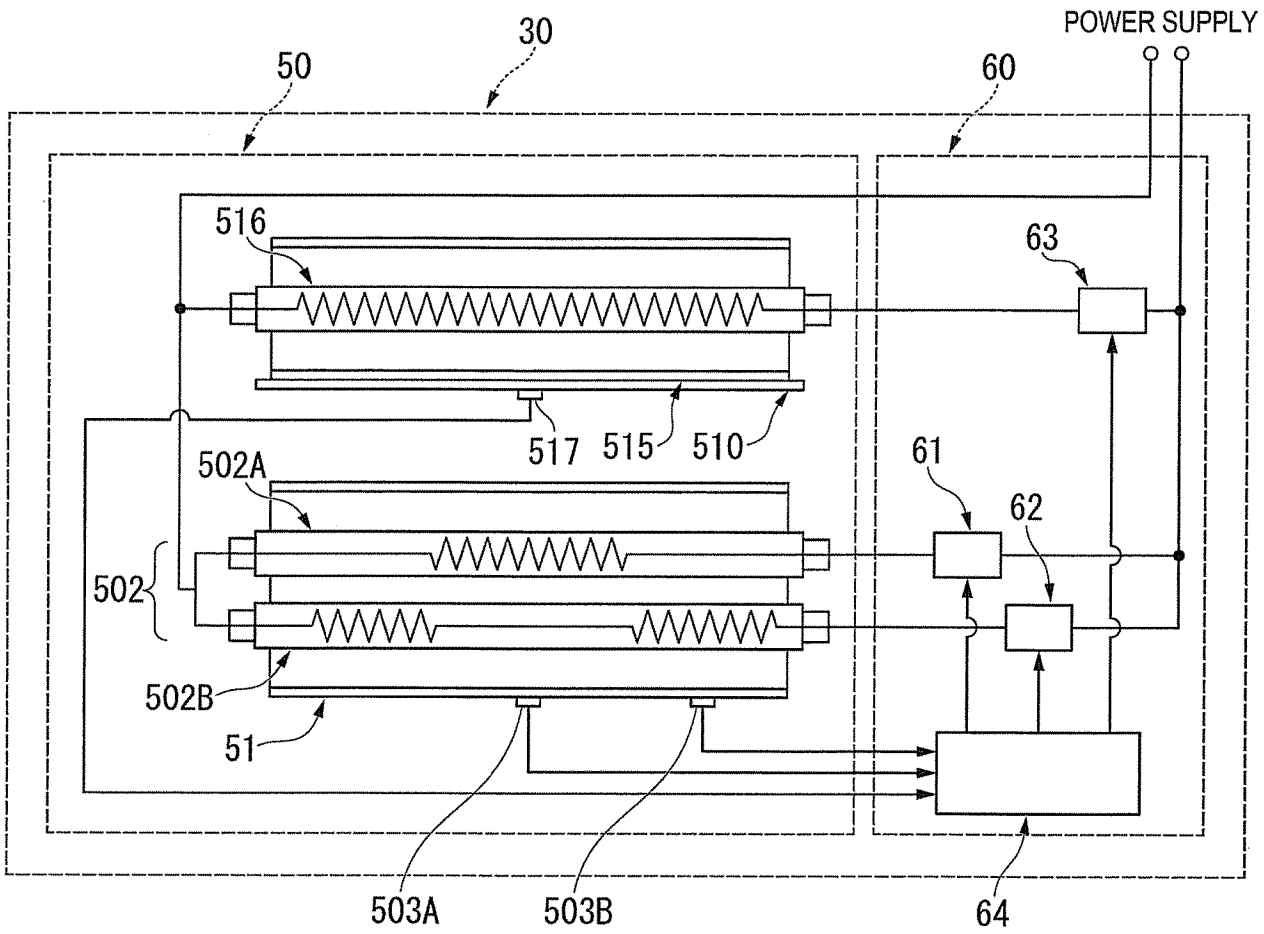
FIG. 3 is a schematic diagram showing a control mechanism of the fixing device.

FIG. 3 is a diagram showing the configuration of a control mechanism of the fixing device 30. The HR lamp 502 includes a plurality of lamps. The HR lamp 502 includes a first HR lamp 502A and a second HR lamp 502B. The first HR lamp 502A includes a heat generating unit in the vicinity of the center in the length direction of the heat roller 501. The first HR lamp 502A generates heat to thereby heat the vicinity of the center in the length direction of the heat roller 501. The second HR lamp 502B includes heat generating units in the vicinities of both the ends in the length direction of the heat roller 501. The second HR lamp 502B generates heat to thereby heat the vicinities of both the ends in the length direction of the heat roller 501. The pressurizing belt lamp 516 includes a heat generating unit over the entire length direction of the belt heat roller 515. The pressurizing belt lamp 516 generates heat to thereby heat the entire length direction of the belt heat roller 515.

The first HR lamp 502A includes the heat generating unit having, for example, width substantially the same as the sheet width of the A4 portrait size. The second HR lamp 502B includes the heat generating units, for example, in positions corresponding to the vicinities of both the ends of a sheet of the A4 landscape size. The first HR lamp 502A, the second HR lamp 502B, and the pressurizing belt lamp 516 may be configured using lamps having the same power (e.g., 300 W). The first HR lamp 502A, the second HR lamp 502B, and the pressurizing belt lamp 516 may be configured using lamps having different powers.

The HR thermistor 503 includes a plurality of thermistors. In this embodiment, the HR thermistor 503 includes a first HR thermistor 503A and a second HR thermistor 503B. The first HR thermistor 503A is disposed in the vicinity of the center in the length direction of the heat roller 501. The first HR thermistor 503A measures the surface temperature in the vicinity of the center in the length direction of the heat roller 501. The second HR thermistor 503B is disposed in the vicinity of one end in the length direction of the heat roller 501. The second HR thermistor 503B measures the surface temperature in the vicinity of one end in the length direction of the heat roller 501. The pressurizing thermistor 517 is disposed in the vicinity of the belt heat roller 515. For example, the pressurizing thermistor 517 is disposed in the vicinity of the center in the length direction of the belt heat roller 515. In this case, the pressurizing thermistor 517 measures the surface temperature of the pressurizing belt 510 in the vicinity of the center in the length direction of the belt heat roller 515.

The energization controller 60 includes a first switching element 61, a second switching element 62, a third switching element 63, and a controller 64. For example, the first switching element 61, the second switching element 62, and the third switching element 63 are configured using bidirectional thyristors.

The first switching element 61 is provided between a power supply and the first HR lamp 502A. The first switching element 61 takes an ON or OFF state. A state of the first switching element 61 is controlled by the controller 64. If the first switching element 61 is in the ON state, alternating-current power is supplied to the first HR lamp 502A from the power supply. The second switching element 62 is provided between the power supply and the second HR lamp 502B. The second switching element 62 takes an ON or OFF state. A state of the second switching element 62 is controlled by the controller 64. If the second switching element 62 is in the ON state, alternating-current power is supplied to the second HR lamp 502B from the power supply. The third switching element 63 is provided between the power supply and the pressurizing belt lamp 516. The third switching element 63 takes an ON or OFF state. A state of the third switching element 63 is controlled by the controller 64. If the third switching element 63 is in the ON state, alternating-current power is supplied to the pressurizing belt lamp 516 from the power supply.

The controller 64 acquires signals output from the first HR thermistor 503A, the second HR thermistor 503B, and the pressurizing thermistor 517. The controller 64 acquires a measurement result of temperature (hereinafter referred to as "measured temperature") on the basis of the acquired signals. The controller 64 controls the first switching element 61, the second switching element 62, and the third switching element 63 according to the acquired measured temperature. For example, the controller 64 may acquire an average of measurement values of the first HR thermistor 503A and the second HR thermistor 503B as the measured temperature.

The controller 64 controls the switching elements to thereby perform thinning control of power supply to the lamps. When performing the thinning control, the controller 64 controls ON and OFF of the switching elements at a short cycle. According to such control, alternating-current electric energy per time supplied to the lamps is adjusted. The control of ON and OFF may be performed at a zero cross of an alternating-current voltage. Since such control is performed, it is possible to perform safe thinning control with less energy loss. The thinning control may be applied to only the first HR thermistor 503A and the second thermistor 503B.

Figures 4A, 4B:
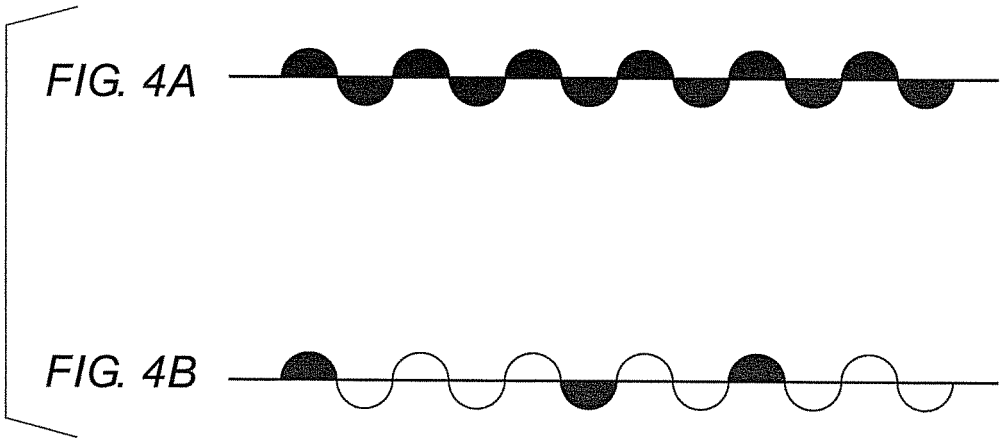
FIG. 4A is a diagram showing a temperature change of a supply voltage that occurs if alternating-current power is supplied 100% without being subjected to thinning control.
FIG. 4B is a diagram showing a temperature change of a supply voltage that occurs if the alternating-current power is supplied 25% while being subjected to the thinning control.

FIGS. 4A and 4B are schematic diagrams showing the thinning control. FIG. 4A is a diagram showing a temperature change of a supply voltage that occurs if alternating-current power is supplied 100% without being subjected to the thinning control. FIG. 4B is a diagram showing a temperature change of a supply voltage that occurs if the alternating-current power is supplied 25% while being subjected to the thinning control. Waveforms shown in FIGS. 4A and 4B indicate temporal changes of a voltage value supplied from the power supply to the fixing device 30. Black portions on the inner sides of the waveforms indicate a voltage supplied to the lamps. White portions on the inner sides of the waveforms indicate a voltage not supplied to the lamp by the thinning control.

In a state of 100% supply, the thinning control is not performed. Therefore, all the voltage supplied from the power supply to the fixing device 30 is supplied to the lamps. On the other hand, in a state of 25% supply (a state of a thinning ratio of 75%), the alternating-current power supply is stopped for time equivalent to 75% in total in a predetermined time. As the time in which the alternating-current power supply is stopped, time equivalent to 25% is not continuously provided but time equivalent to less than 25% is intermittently provided a plurality of times.

Figure 5:
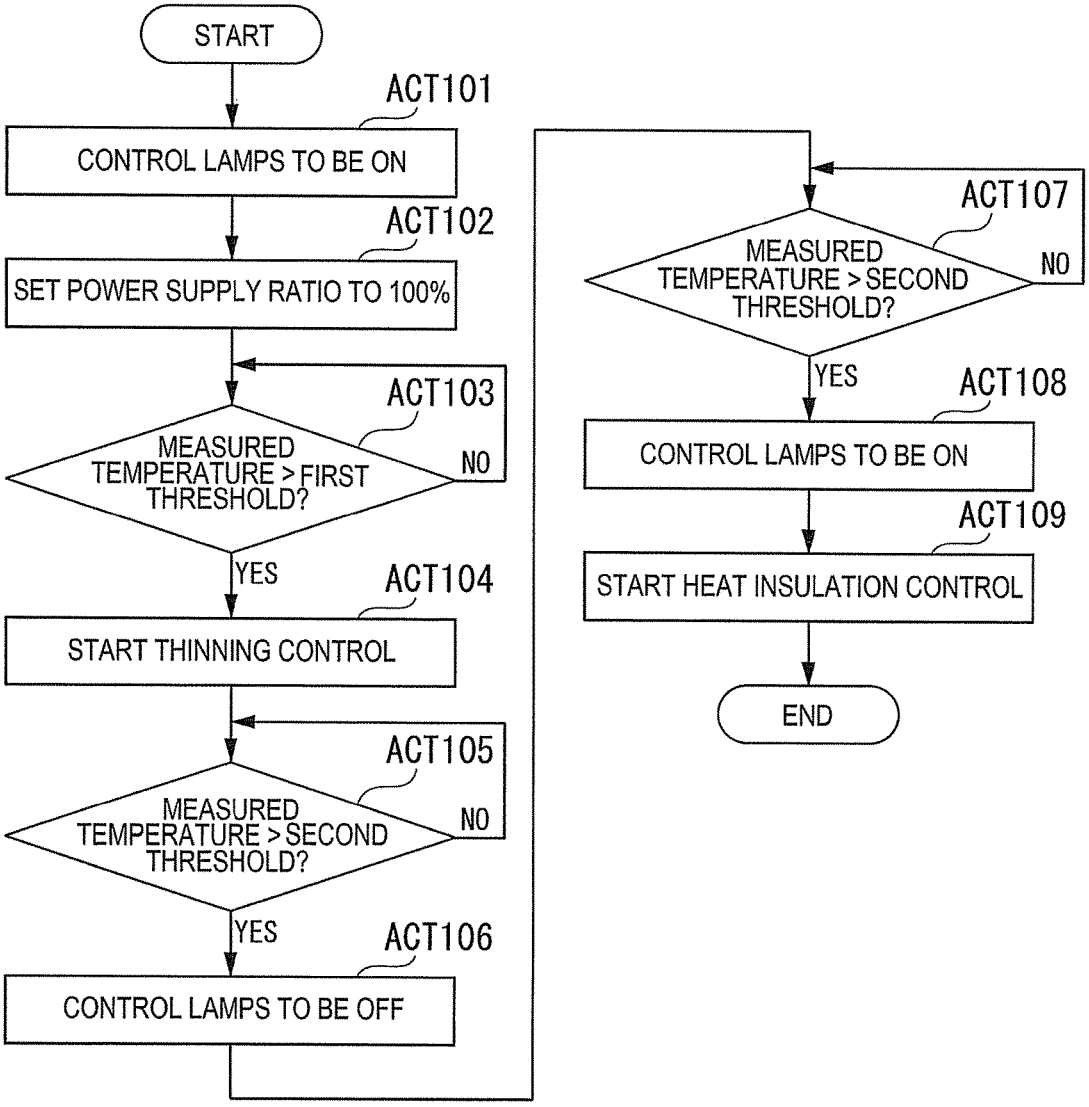
FIG. 5 is a flowchart for explaining an example of a flow of warming-up processing of a the fixing device.

FIG. 5 is a flowchart for explaining an example of a flow of warming-up processing of the fixing device 30. When warming-up of the fixing device 30 is started, the controller 64 controls the lamps to be ON (ACT 101). The lamps controlled to be ON in ACT 101 are the first HR lamp 502A, the second HR lamp 502B, and the pressurizing belt lamp 516. At this point in time, the controller 64 does not execute the thinning control on the lamps controlled to be ON in ACT 101. That is, the controller 64 controls the switching elements to set a power supply ratio to 100% (ACT 102). Thereafter, the controller 64 determines on the basis of measurement results output from the thermistors whether a measured temperature exceeds a first threshold (ACT 103). If the measured temperature does not exceed the first threshold (NO in ACT 103), the controller 64 does not start the thinning control. If the measured temperature exceeds the first threshold (YES in ACT 103), the controller 64 starts the thinning control (ACT 104). In this case, the controller 64 performs the thinning control at a predetermined thinning ratio (e.g. 75%). The lamps subjected to the thinning control in ACT 104 are the first HR lamp 502A and the second HR lamp 502B. The first threshold is smaller than a target value (a READY temperature) of the temperature of the heat roller 501.

Thereafter, the controller 64 determines on the basis of measurement results output from the thermistors whether a measured temperature exceeds a second threshold (Act 105). If the measured temperature does not exceed the second threshold (NO in ACT 105), the controller 64 continues the thinning control while keeping the lamps in the ON state. If the measured temperature exceeds the second threshold (YES in ACT 105), the controller 64 controls the lamps to be OFF (ACT 106). The lamps controlled to be OFF in ACT 106 are the first HR lamp 502A, the second HR lamp 502B, and the pressurizing belt lamp 516. The second threshold is a value close to or the same as the target value (the READY temperature) of the temperature of the heat roller 501. The second threshold is larger than the first threshold. The second threshold is closer to the READY temperature than the first threshold.

Thereafter, the controller 64 determines on the basis of measurement results output from the thermistors whether a measured temperature falls below the second threshold (ACT 107). If the measured temperature does not fall below the second threshold (NO in ACT 107), the controller 64 maintains the lamps in the OFF state. If the measured temperature falls below the second threshold (YES in ACT 107), the controller 64 controls the lamps to be ON (ACT 108). The lamps controlled to be ON in ACT 108 are the first HR lamp 502A, the second HR lamp 502B, and the pressurizing belt lamp 516. The controller 64 starts heat insulation control (ACT 109). The lamps subjected to the heat insulation control in ACT 109 are the first HR lamp 502A, the second HR lamp 502B, and the pressurizing belt lamp 516. Then, the warming-up processing ends.

In the image forming apparatus 100 configured in this way, the lamps of the fixing device 30 are subjected to the thinning control. For example, the thinning control is performed when the heat roller 501 is heated in the warming-up processing. Therefore, it is possible to reduce overshoot that occurs in the heating of the heat roller 501. Such an effect is useful, in particular, in a situation explained below. In recent years, in apart of countries including Japan, new standards for energy saving have been specified. In such standards, improvement of heat efficiency of a heat roller is decided for a reduction of electric power required for the warming-up processing. Specifically, a reduction in the thickness of the heat roller, improvement of a heat insulation effect, and the like are decided. As a result, temperature rising speed increases. Therefore, large overshoot is likely to occur in a short time (a first situation). In some case, the temperature of the heat roller rises to temperature for disconnecting a relay and a failure of the fixing device is caused (a second situation). The image forming apparatus in the embodiment is capable of reducing the overshoot.

Figure 6:
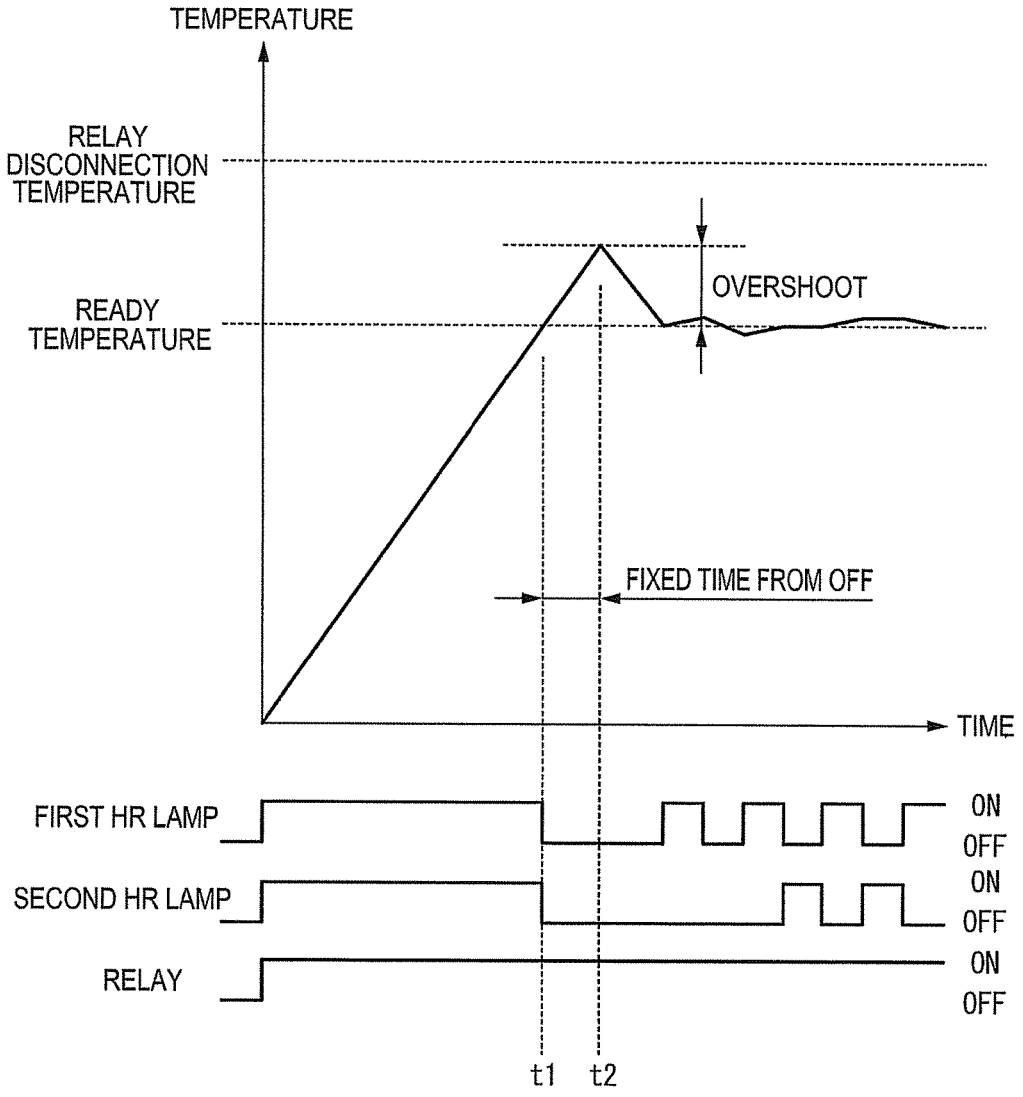
FIG. 6 is a diagram showing a temporal change of the temperature of a heat roller that occurs if the thinning control is not performed (a first situation)
Figure 7:
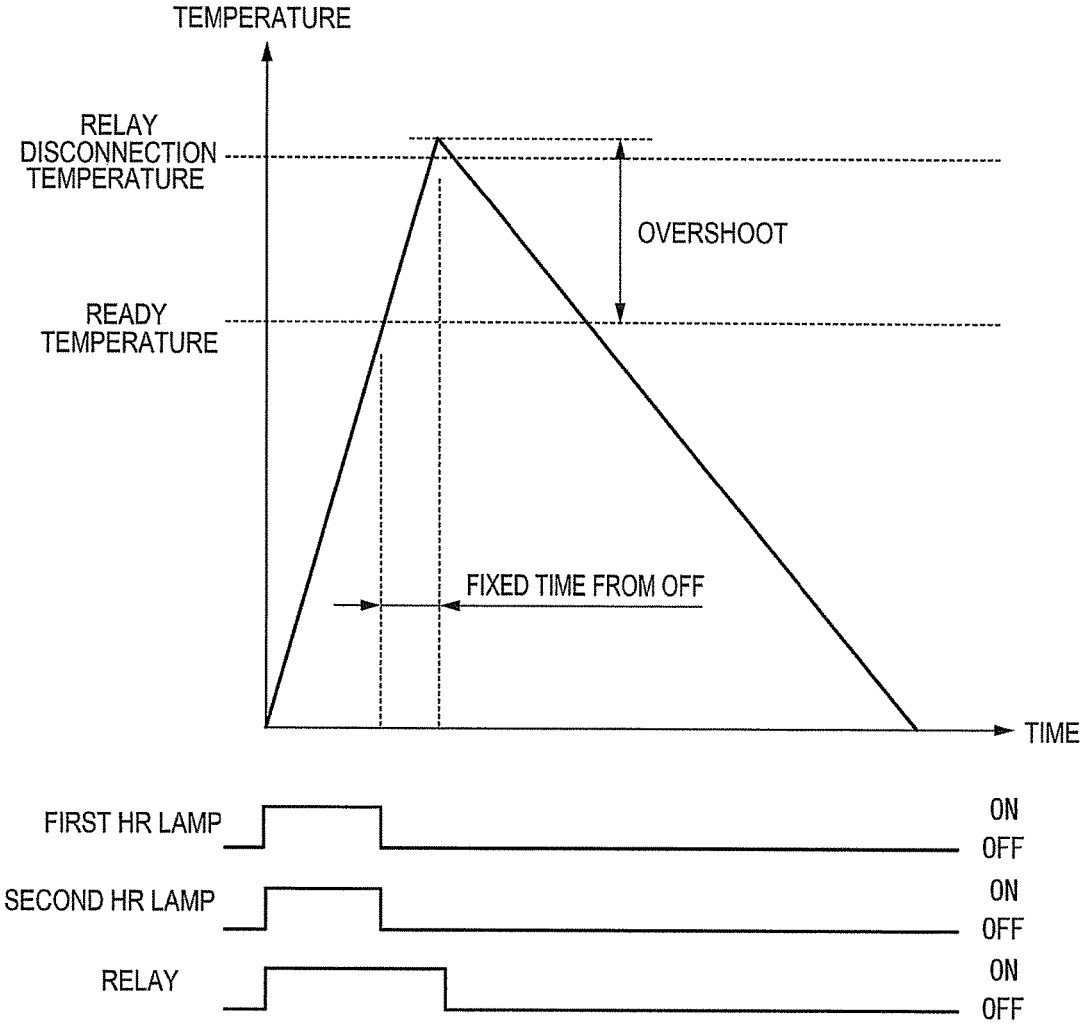
FIG. 7 is a diagram showing a temporal change of the temperature of the heat roller that occurs if the thinning control is not performed (a second situation)

Effects of the image forming apparatus 100 in the embodiment are explained below with reference to FIGS. 6 to 8. FIG. 6 is a diagram showing a temporal change of the temperature of the heat roller that occurs if the thinning control is not performed (the first situation). FIG. 7 is a diagram showing a temporal change of the temperature of the heat roller that occurs if the thinning control is not performed (the second situation). In FIGS. 6 and 7, the lamps are controlled to be ON according to the start of the warming-up processing. Thereafter, 100% electric power is supplied to the lamps until a measured temperature reaches the READY temperature (equivalent to the second threshold). If the measured temperature reaches the READY temperature, the lamps are controlled to be OFF. However, thereafter, the heat roller is still heated by residual heat of the lamps. The temperature rises for a fixed time. The temperature rise is the overshoot. In FIG. 7, a gradient of a rise in the temperature is steep compared with FIG. 6. Therefore, the overshoot also increases and the temperature of the heat roller exceeds a relay disconnection temperature. In this case, the heat roller is likely to be damaged.

Figure 8:
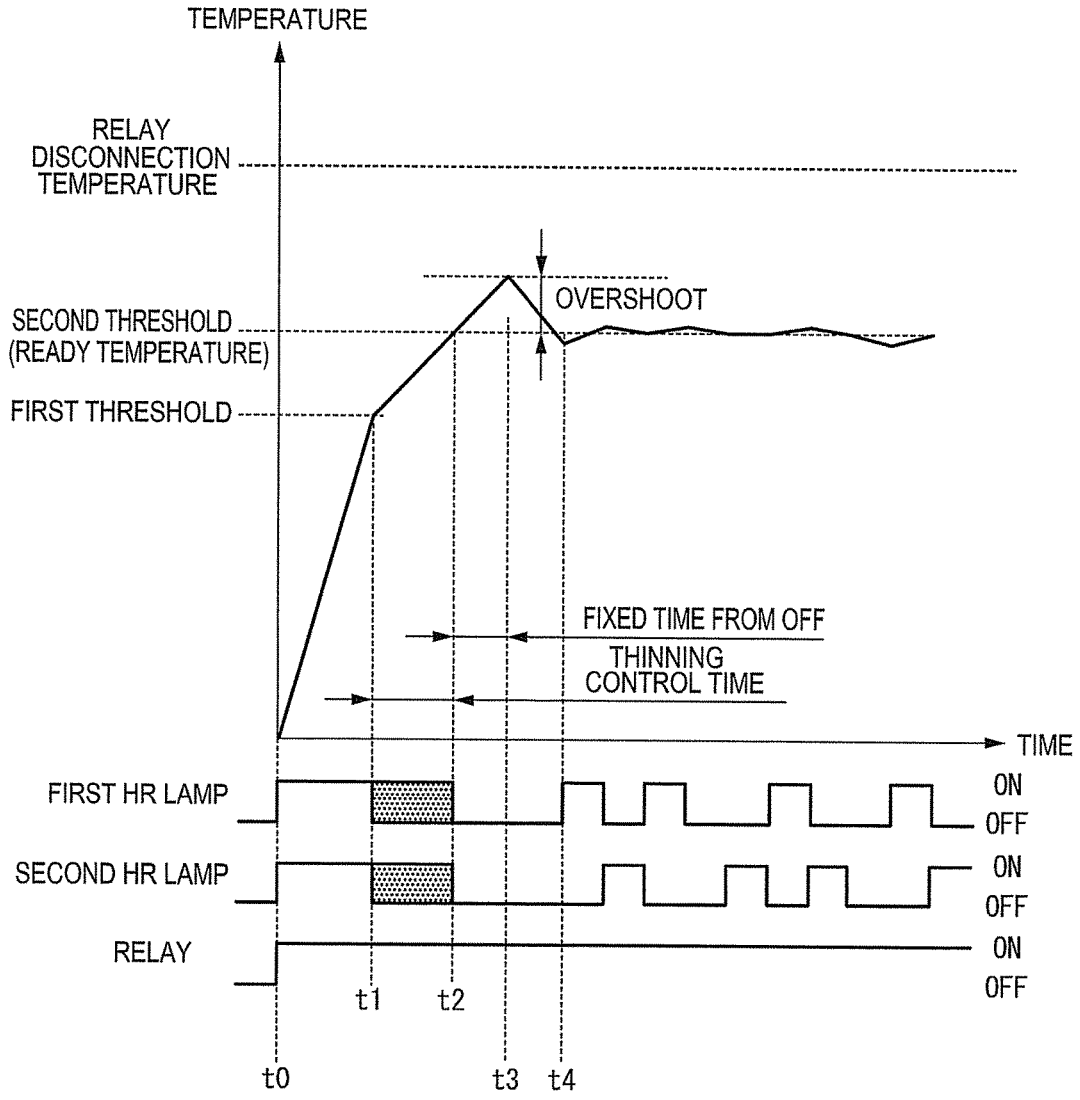
FIG. 8 is a diagram showing a temporal change of the temperature of the heat roller of the image forming apparatus in the embodiment.

FIG. 8 is a diagram showing a temporal change of the temperature of the heat roller 501 of the image forming apparatus 100 in the embodiment. Time t0 indicates time when the warming-up processing is started. When the warming-up processing is started, the controller 64 controls the first HR lamp 502A and the second HR lamp 502B to be ON. That is, at time t0, the controller 64 causes the first HR lamp 502A and the second HR lamp 502B to start heat generation.

At this point, the thinning control is not executed. Therefore, electric energy supplied to the first HR lamp 502A and the second HR lamp 502B is electric energy equivalent to 100% of a predetermined value. The predetermined value is, for example, a value supplied to a lamp of a fixing device of an image forming apparatus in the past.

If a measured temperature exceeds the first threshold at time t1, the controller 64 starts the thinning control. In the thinning control, the electric energy supplied to the first HR lamp 502A and the second HR lamp 502B is less than 100%. Therefore, after time t1, a temperature rising gradient is gentle compared with before time t1.

If the measured temperature exceeds the second threshold at time t2, the controller 64 controls the first HR lamp 502A and the second HR lamp 502B to be OFF. Thereafter, the measured temperature still rises with residual heat for a certain degree of time (between t2 and t3). However, the temperature rising gradient at time t2 is gentle compared with FIGS. 6 and 7. Therefore, the overshoot is also small compared with FIGS. 6 and 7.

After time t3, the measured temperature starts to drop. Thereafter, if the measured temperature falls below the second threshold at time t4, the controller 64 starts heat insulation control.

Modifications

The second HR thermistor 503B may be disposed in the vicinities of both the ends in the length direction of the heat roller 501.

In the thinning control, the controller 64 may control electric energy using a plurality of kinds of thinning ratios. For example, the controller 64 may perform the thinning control at a lower thinning ratio for a predetermined time after the measured temperature exceeds the first threshold and thereafter perform the thinning control at a higher thinning ratio. With such a configuration, it is possible to reduce time required until the measured temperature reaches the READY temperature.

The controller 64 may determine, according to time rather than the measured temperature, a period in which the thinning control is performed. For example, the controller 64 may execute the warming-up processing as explained below. The controller 64 does not perform the thinning control until a first time elapses after the warming-up processing is started. If the first time elapses after the warming-up processing is started, the controller 64 starts the thinning control. If a second time elapses after the thinning control is started, the controller 64 controls the first HR lamp 502A and the second HR lamp 502B to be OFF.

Timing when the thinning control is executed does not need to be limited to timing during the warming-up processing. The thinning control may be performed at any timing as long as the timing is timing during processing for heating a member of the fixing device with a heat generating body such as a lamp.

In the flowchart of FIG. 5, the thinning control may be started at the timing of ACT 102. In this case, the thinning ratio of the thinning control performed in ACT 102 is lower than the thinning ratio of the thinning control performed in ACT 104. That is, the electric energy supplied by the thinning control in ACT 102 is larger than the electric energy supplied by the thinning control in ACT 104.

While certain embodiments have been described these embodiments have been presented by way of example only, and are not intended to limit the scope of the inventions. Indeed, the novel embodiments described herein may be embodied in a variety of other forms: furthermore various omissions, substitutions and changes in the form of the embodiments described herein may be made without departing from the spirit of the inventions. The accompanying claims and there equivalents are intended to cover such forms or modifications as would fall within the scope and spirit of the invention.

What is claimed is:

1. A fixing device comprising:
- a heat roller configured to heat a conveyed sheet;
- a heat generating body configured to execute heat with electric power in the heat roller; and
- a controller configured to perform a thinning control after a first time elapsed without performing the thinning control until the first time elapses, wherein the controller is configured to stop supply of the electric power to the heat generating body if a second time period has elapsed after the first time had elapsed.

2. The fixing device according to claim 1, wherein the controller is configured to count the first time after starting a warming-up processing.

3. The fixing device according to claim 1, wherein the controller is configured to perform the thinning control at a lower thinning rate in a predetermined time period after the first time elapsed; the controller is configured to perform the thinning control at a higher thinning rate after the predetermined time period elapsed.

4. An image forming apparatus comprising:
- a heat roller configured to heat a conveyed sheet;
- a heat generating body configured to execute heat with electric power in the heat roller; and
- a controller configured to perform a thinning control after a first time elapsed without performing the thinning control until the first time elapses, wherein the controller is configured to stop supply of the electric power to the heat generating body if a second time period has elapsed after the first time had elapsed.

5. The image forming apparatus according to claim 4, wherein the controller is configured to count the first time after starting a warming-up processing.

6. The image forming apparatus according to claim 4, wherein the controller is configured to perform the thinning control at a lower thinning rate in a predetermined time period after the first time elapsed; the controller is configured to perform the thinning control at a higher thinning rate after the predetermined time period elapsed.

7. A fixing method comprising:
- heating a conveyed sheet;
- executing heat with electric power in the heat roller;
- performing a thinning control after a first time elapsed without performing the thinning control until the first time elapses, wherein performing the thinning control comprises stopping supply of the electric power to the heat generating body if a second time period has elapsed after the first time had elapsed.

8. The fixing method according to claim 7, wherein performing the thinning control comprises counting the first time after starting a warming-up processing.

9. The fixing method according to claim 7, wherein performing the thinning control comprises:
- performing the thinning control at a lower thinning rate in a predetermined time period after the first time elapsed; and
- performing the thinning control at a higher thinning rate after the predetermined time period elapsed.

* * * * *